US007083505B2

(12) United States Patent
Carlson, III

(10) Patent No.: US 7,083,505 B2
(45) Date of Patent: Aug. 1, 2006

(54) STACKED TRIPLE WHEEL HEAD ASSEMBLY

(75) Inventor: Glen A. Carlson, III, Auburn Hills, MI (US)

(73) Assignee: Acme Manufacturing Company, Auburn Hills, MI (US)

( * ) Notice: Subject to any disclaimer, the term of this patent is extended or adjusted under 35 U.S.C. 154(b) by 85 days.

(21) Appl. No.: 10/943,152

(22) Filed: Sep. 16, 2004

(65) Prior Publication Data

US 2005/0148284 A1 Jul. 7, 2005

Related U.S. Application Data

(60) Provisional application No. 60/503,284, filed on Sep. 16, 2003.

(51) Int. Cl.
*B24B 7/00* (2006.01)
*B24B 21/00* (2006.01)

(52) U.S. Cl. ..... 451/66; 451/302; 451/309; 451/361

(58) Field of Classification Search ..... 451/57, 451/58, 65, 66, 69, 70, 194, 195, 302, 309, 451/361

See application file for complete search history.

(56) References Cited

U.S. PATENT DOCUMENTS

| | | | | |
|---|---|---|---|---|
| 2,859,627 | A * | 11/1958 | Gallop, Jr. | 74/16 |
| 3,067,443 | A * | 12/1962 | Romens et al. | 15/21.1 |
| 3,895,464 | A * | 7/1975 | Kiser | 451/301 |
| 3,977,127 | A * | 8/1976 | Mahnken | 451/67 |
| 5,655,949 | A * | 8/1997 | Clover | 451/41 |
| 5,951,373 | A * | 9/1999 | Shendon et al. | 451/41 |
| 6,071,183 | A * | 6/2000 | Havins | 451/296 |

* cited by examiner

*Primary Examiner*—Timothy V. Eley
(74) *Attorney, Agent, or Firm*—Harness, Dickey & Pierce, P.L.C.

(57) ABSTRACT

A stacked three head finishing apparatus is provided. The apparatus includes a base mountable to a floor, a first head mounted to the base, a second head mounted to the base above the first head, and a third head mounted to the base above the second head. Each of the first, second, and third heads includes a rotatable wheel. A motor imparts rotation to the wheel which may then be used for finishing operations. The height of each head above the floor and the position relative to one another is pre-selected to ensure that all of the heads are within reach of a robot arm and to ensure that nothing will interfere with the movement of the robot arm.

19 Claims, 5 Drawing Sheets

STACKED TRIPLE WHEEL HEAD ASSEMBLY

CROSS-REFERENCE TO RELATED APPLICATIONS

This application claims the benefit of U.S. Provisional Application No. 60/503284, filed on Sep. 16, 2003. The disclosure of the above application is incorporated herein by reference.

FIELD OF THE INVENTION

The present invention relates to robotic finishing systems and, more particularly, to a triple head finishing system.

BACKGROUND OF THE INVENTION

Metalworking typically requires surface finishing such as buffing, polishing, deburring, grinding and satin finishing. Such finishing steps were traditionally performed manually. More recently, however, automated processing replaced most manual operations. As compared to manual finishing, automated finishing provides greater efficiency, precision, and safety.

In automated finishing, it is desirable to perform as many process steps as possible at a single location. This reduces the need to transport parts from one station to another, minimizes required floor space for equipment and inventory, and increases efficiency. One exemplary apparatus for increasing automated process capacity is a stacked wheel head assembly.

In known stacked head assemblies, two rotating wheels are arranged one over another in a spaced apart stacked configuration. This design enables a robot arm to position a part against one wheel for an initial finishing operation and then to move the part to a second wheel for a subsequent operation. Since the wheels are stacked, the amount of floor space required for the two steps is minimized. Also, the robot need only minimally move to transport the part from the first wheel to the second wheel.

While such stacked head assemblies provide great advantages, there is still room for improvement in the art. For example, it would be desirable to provide a three or more head design so that a third or more process steps could be implemented within the same amount of floor space as the two head design. An important consideration in such a design, however, is to ensure that the robot can reach each of the wheels without interference. Otherwise, the part cannot be properly finished.

SUMMARY OF THE INVENTION

The above and other objects are provided by an apparatus including three stacked heads. More particularly, one embodiment of the present invention includes a base mountable to a floor, a first head mounted to the base, a second head mounted to the base above the first head, and a third head mounted to the base above the second head. Each of the first, second, and third heads includes a rotatable wheel.

The wheel may take the form of a contact wheel supporting an abrasive belt or may take the form of other types of finishing media such as a flapper wheel, buffing wheel, or brush wheel. When an abrasive belt is employed, it is rotatably supported by a contact wheel at one end and by an idler pulley at a second end spaced apart from the contact wheel. A motor imparts rotation to the contact wheel which in turn rotates the abrasive belt. The idler pulley maintains the tension of the abrasive belt.

The height of each head is pre-selected to ensure that all of the heads are within reach of a robot arm. The space between the heads is also pre-selected to ensure that nothing will interfere with the movement of the robot arm. In a preferred embodiment, the first head is fixed against lateral movement while the second and third heads float to allow lateral movement. In this way, the first head can be used for a grinding operation while the second and third heads can be used for additional finishing steps or operations.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
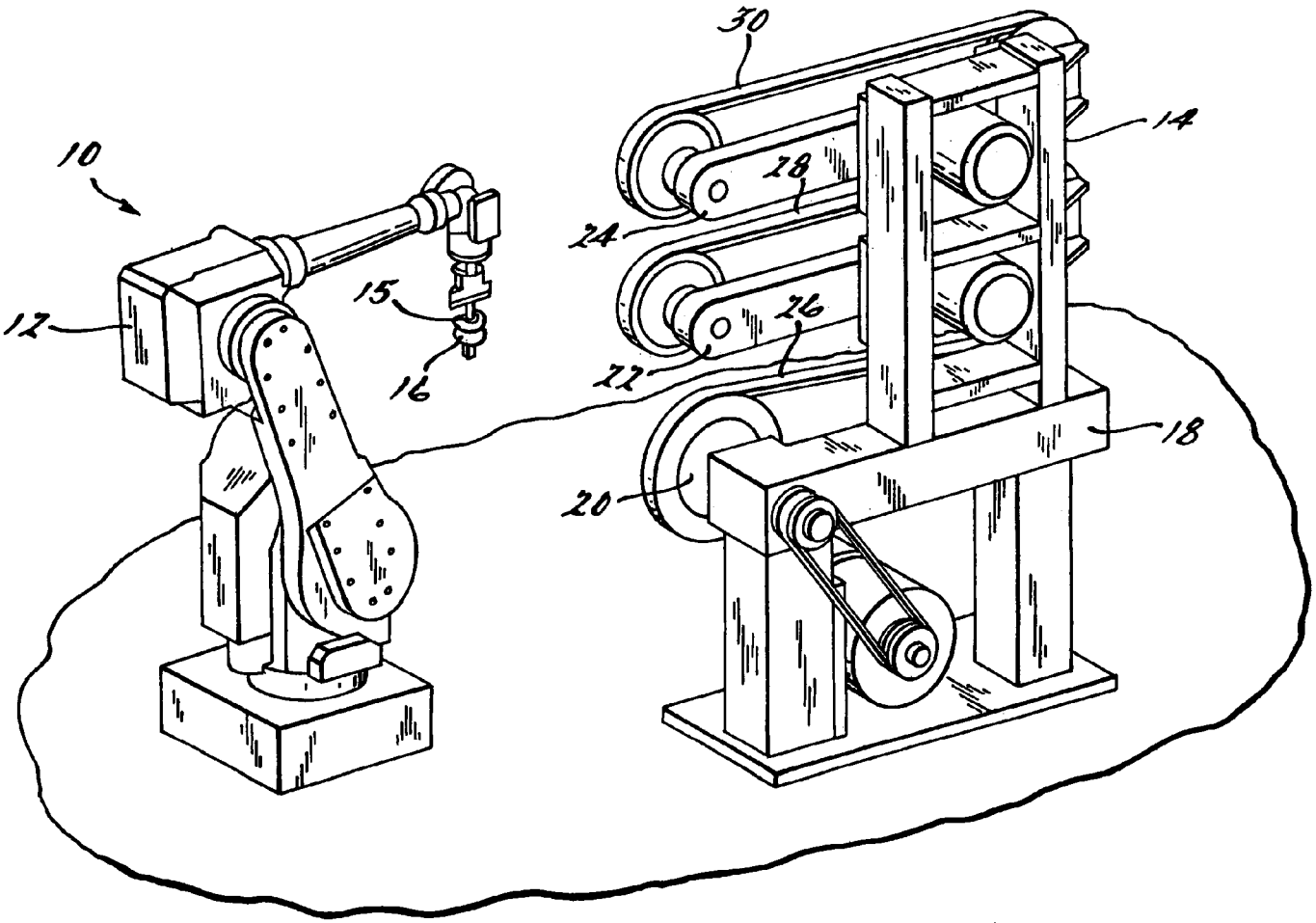
FIG. 1 is a perspective view of a robotic cell incorporating a triple wheel head apparatus according to the present invention.
Figure 2:
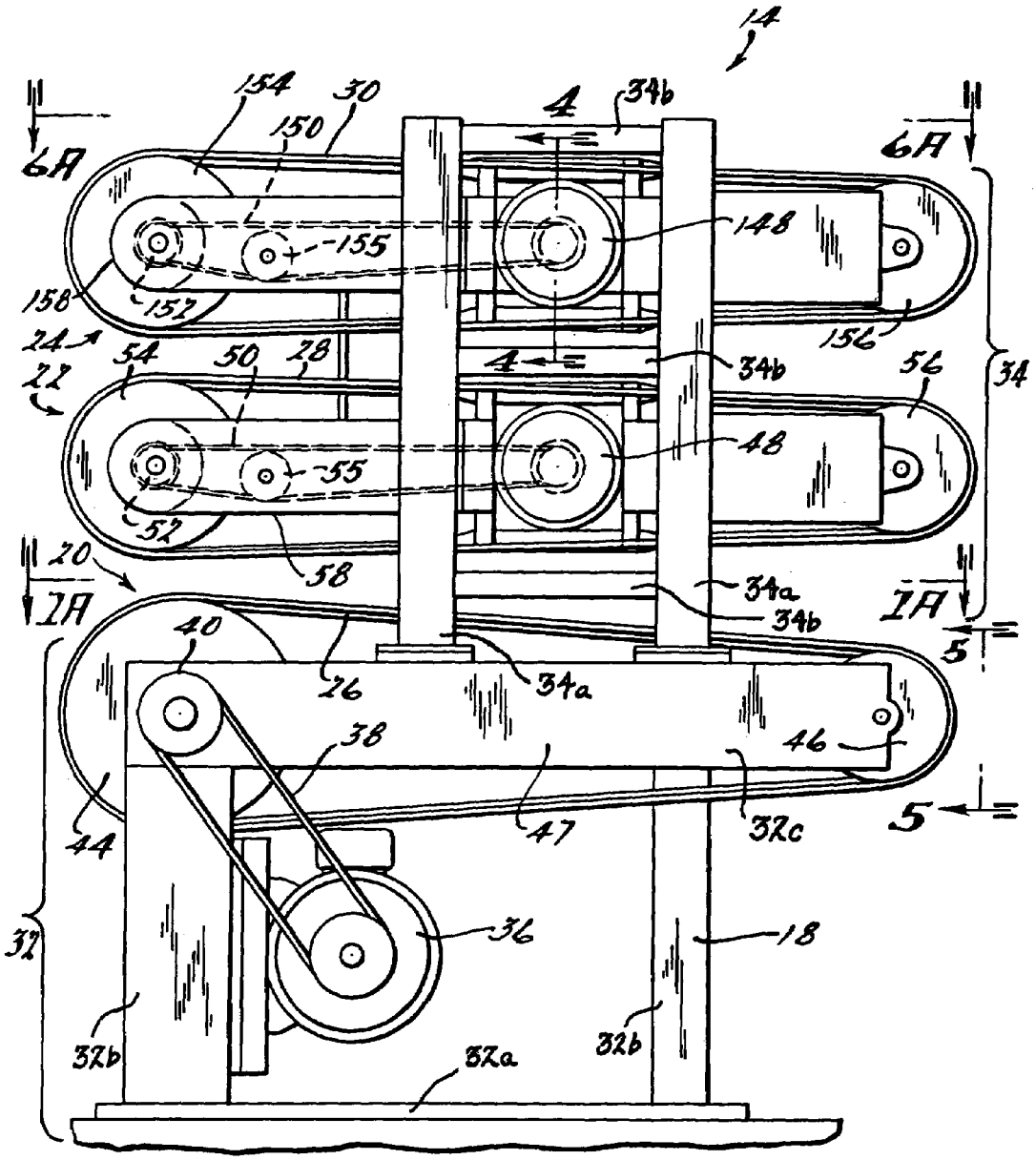
FIG. 2 is a side view of the triple wheel head apparatus according to the present invention.
Figure 3:
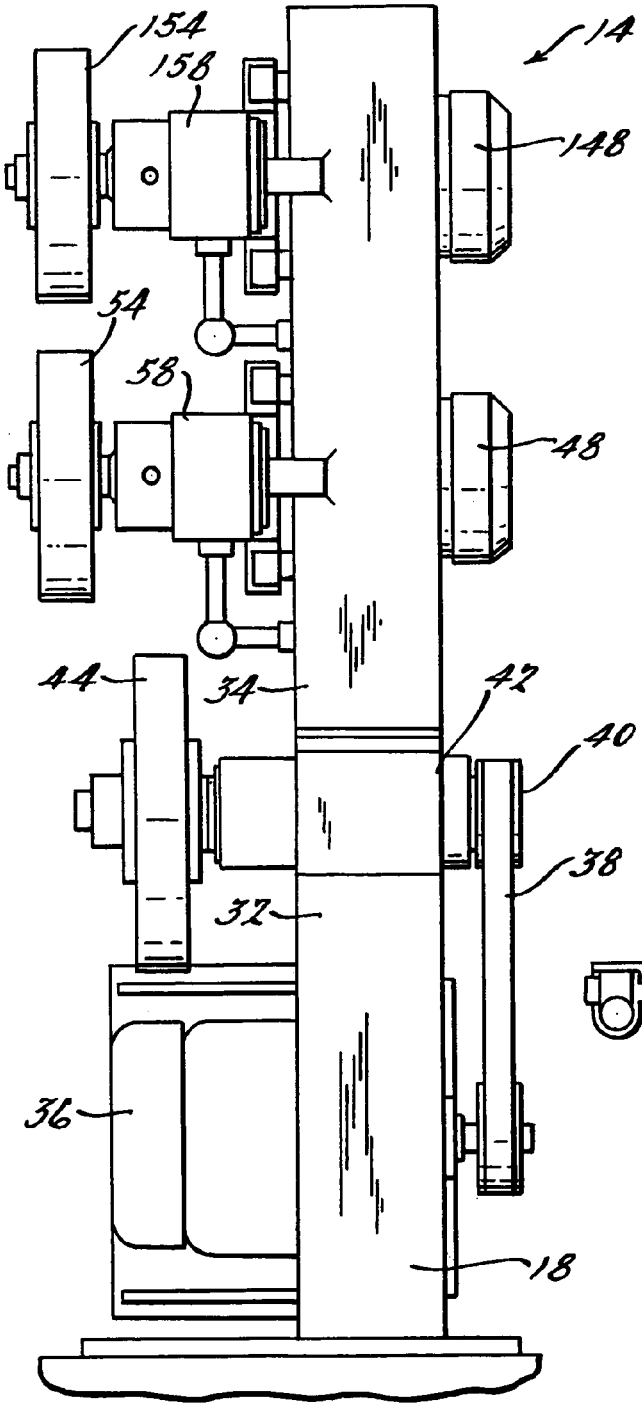
FIG. 3 is a front view of the triple wheel head apparatus according to the present invention.
Figure 4:
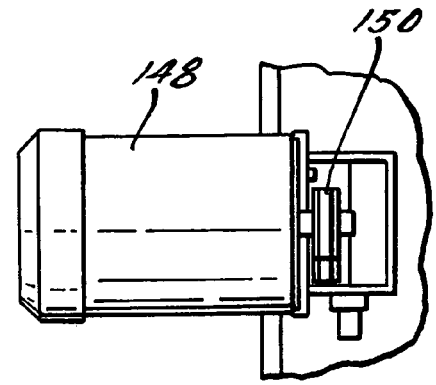
FIG. 4 is a side view of a motor employed in the triple wheel head apparatus according to the present invention.

Referring to FIG. 1, one embodiment of the present invention is illustrated. The assembly includes a robotic work cell 10 including a robot 12 and a stacked wheel head apparatus 14. The robot 12 is preferably a six axis robot manufactured by, for example, Fanuc. The robot 12 holds a fixture 15 secured to a part 16. The part 16 is subject to multiple finishing operations at the stacked wheel head apparatus 14. In the illustrated example, the part 16 is in the form of a prosthetic knee.

The apparatus 14 includes a base 18 supporting three wheel heads 20, 22 and 24 which are vertically spaced apart from one another. Each of the heads 20, 22, and 24 includes a rotatable wheel supporting a finishing belt 26, 28, and 30 respectively. The belts 26, 28 and 30 are used for finishing (e.g., buffing, polishing, deburring, grinding, satin finishing, etc.) the part 16. In the embodiment described and illustrated, the head 20 is fixed for use in a grinding step while the heads 22 and 24 float for use in polishing steps. Although each head 20, 22, and 24 is illustrated with a contact wheel supporting a finishing belt, one skilled in the art will appreciate that the contact wheels illustrated may be replaced with flapper wheels, buffing wheels, and/or brush wheels, among others.

An important aspect of the present invention is the arrangement of the heads 20, 22, and 24 relative to one another and relative to the robot 12. More particularly, since the heads 20, 22, and 24 are vertically stacked, less floor space is required to accommodate three processing stations. However, the positions of the heads 20, 22, and 24 are carefully selected to ensure that the robot 12 can reach each wheel or belt 26, 28, and 30, and to ensure that none of the heads 20, 22, or 24 interfere with the movement of the robot 12.

Turning now to FIGS. 2–7C, the apparatus 14 is illustrated in greater detail. The base 18 includes a lower portion 32 having a generally planar lower support panel 32*a* directly mounted to a floor (see FIG. 1) and connected to a pair of vertically extending legs 32*b* supporting a rectangular upper support cross bar 32*c*. The lower portion 32 supports a laterally offset upper portion 34 including a pair of vertically extending side members 34*a* connected (e.g., bolted) to the upper support cross bar 32*c* of the lower portion 32. A plurality (e.g., three) of horizontally extending cross panels 34*b* extend between the pair of side members 34*a*.

One of the pair of side members 34*a* is substantially vertically aligned with one of the pair of legs 32*b*. The other of the pair of side members 34*a* is laterally offset relative to the other of the pair of legs 32*b* so as to connect near a midpoint of the upper support bar 32*c*. Both the lower and upper portions 32 and 34 are preferably formed of steel components which are welded together to ensure adequate strength and rigidity.

The first head 20 includes a first motor 36 mounted to the interior of the lower portion 32 of the base 18. Preferably, the first motor 36 is mounted to an interior surface of one of the legs 32*b*. Even more preferably, the first motor 36 is mounted to the one leg 32*b* offset from the upper portion 34. The first motor 36 preferably comprises one of a 15 HP 1200 RPM motor and a 15 HP 3600 RPM motor although other motors could substitute therefore. A first power belt 38 drivingly interconnects the motor 36 and a pulley 40 mounted to the lower portion 32 of the base 18. The pulley 40 is preferably mounted at a reinforced interface of the upper support cross bar 32*c* and the leg 32*b* to which the first motor 36 is connected. A spindle 42 traversing the width of the lower portion 32 transfers rotation of the pulley 40 at the rear side of the lower portion 32 of the base 18 to a first wheel 44 at the front side of the lower portion 32 of the base. In the illustrated example, the first wheel 44 is in the form of a contact wheel for supporting the first finishing belt 26.

Figure 5:
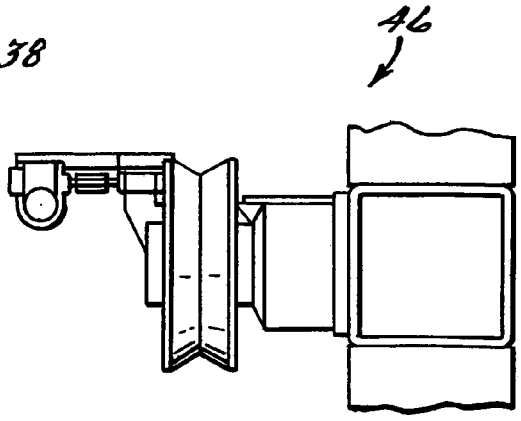
FIG. 5 is a side view of a finishing belt idler pulley of the triple wheel head apparatus according to the present invention.
Figure 6A:
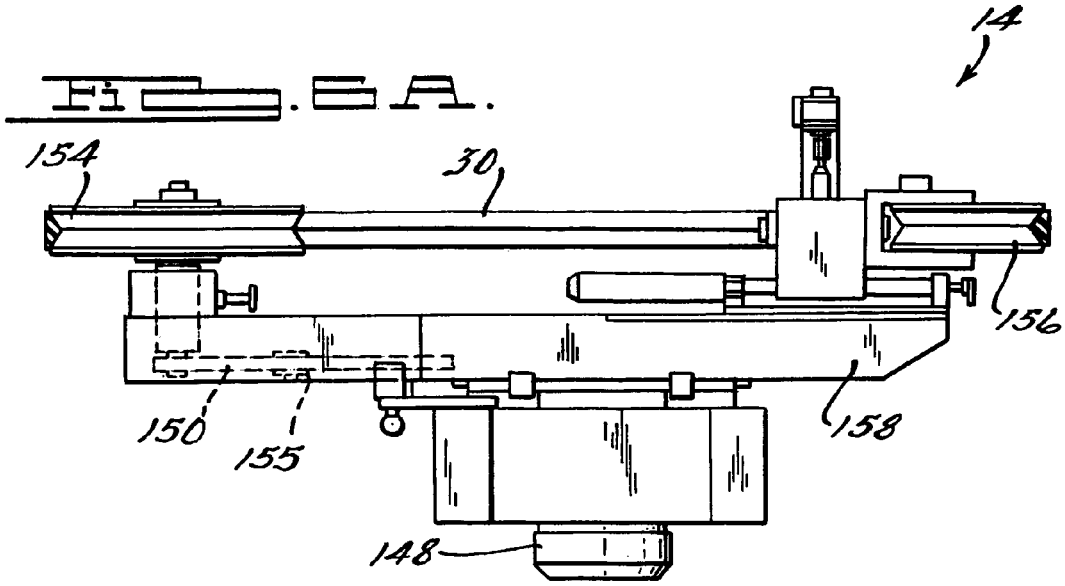
FIG. 6A is a plan view of the triple wheel head apparatus according to the present invention.
Figure 6B:
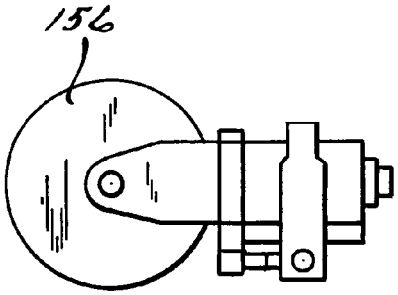
FIG. 6B is a front view of a finishing belt idler pulley of the triple wheel head apparatus according to the present invention.
Figure 6C:
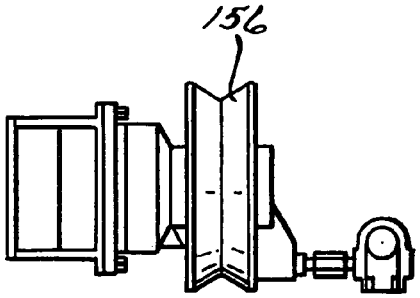
FIG. 6C is a side view of a finishing belt idler pulley of the triple wheel head apparatus according to the present invention.
Figure 7A:
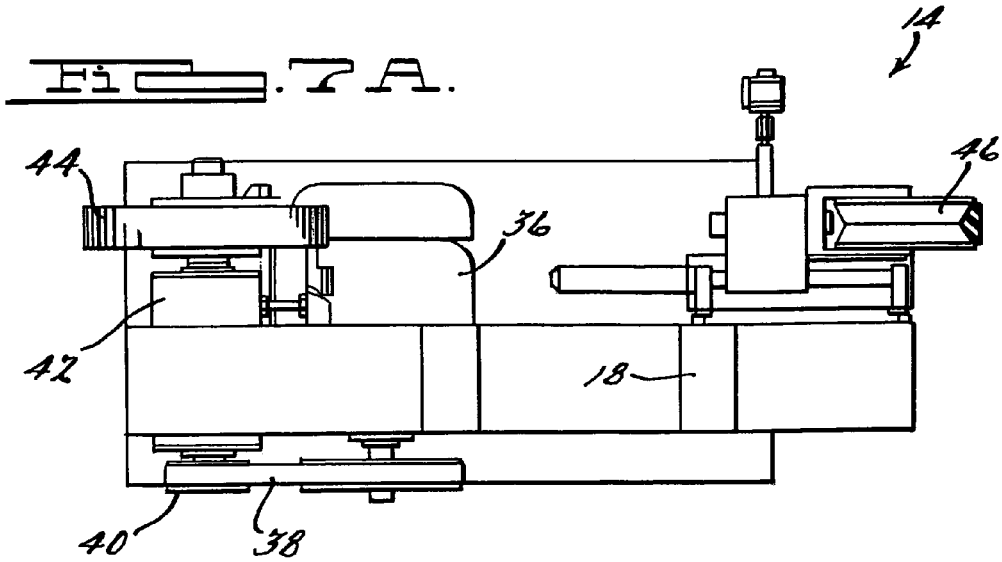
FIG. 7A is a bottom view of the triple wheel head apparatus according to the present invention.
Figure 7B:
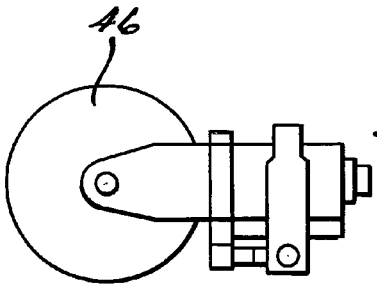
FIG. 7B is a front view of a finishing belt idler pulley of the triple wheel head apparatus according to the present invention.
Figure 7C:
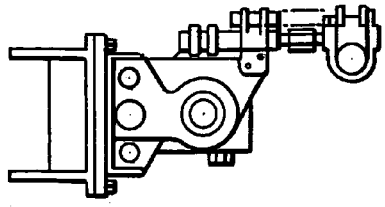
FIG. 7C is a bottom view of a power belt tracking assembly of the triple wheel head apparatus according to the present invention.

The first belt 26 extends between the first wheel 44 and a first abrasive belt idler pulley 46 (see FIG. 5). The idler pulley 46 is mounted to one end of the upper support cross bar 32*c* and the first wheel 44 is mounted to an opposite second end of the upper support cross bar 32*c*. The idler pulley 46 maintains a desired tension on the belt 26. Preferably, the axis of rotation of the idler pulley 46 and the axis of rotation of the first wheel 44 are substantially located along a common horizontal plane above the floor.

In this embodiment, the first wheel 44 is fixed such that it does not move when the wheel 44 and/or finishing belt 26 is used to grind a part (see FIG. 1). This is advantageous in grinding operations to meet the part shape and size tolerances, in accordance with part print specifications. However, if desired, the wheel 44 may also be configured to float such that it can move during polishing and grinding. This may be advantageous in some polishing operations.

The axis of the wheel 44 is preferably positioned 31.5 inches above the floor. This allows the robot arm (see FIG. 1) to reach the wheel 44 and/or belt 26 while still providing ample space thereunder. Such space can be exploited by the robot arm as well as the motor 36.

The second head 22 includes a second motor 48 centrally mounted between the side members 34*a* of the upper portion 34 of the base 18. Preferably, the second motor 48 is mounted between the lower two cross panels 34*b* and laterally offset relative to the first motor 36. Also, the second motor 22 preferably comprises a 5 HP 1800 RPM motor although other motors could substitute therefore. A second power belt 50 drivingly interconnects the second motor 48 and a hub 52. The hub 52 is connected to a second wheel 54 and transfers rotation from the power belt 50 thereto. A power belt idler pulley 55 mounted between the second motor 22 and the hub 52 maintains the tension of the belt 50.

In the illustrated example, the second wheel 54 is in the form of a contact wheel for supporting the second finishing belt 28. The second finishing belt 28 extends between the second wheel 54 and a second abrasive belt idler pulley 56. The idler pulley 56 maintains tension on the belt 28. The second wheel 54, pulley 55, and pulley 56 are all mountably supported on an elongated housing (e.g., an aluminum casting) 58 which is mounted on the upper portion 34 of the base 18 so as to laterally extend beyond both side members 34*a*. Preferably, the second wheel 54 is mounted at one end of the housing 58 while the pulley 56 is mounted to an opposite second end. Also preferably, the axes of rotation of the second wheel 54, second motor 48, and second idler pulley 56 are all substantially located along a common horizontal plane above the floor.

In this embodiment, the second wheel 54 floats by way of a force controlled float mechanism such that it may move when the wheel 54 and/or belt 28 is used to grind or polish a part (see FIG. 1). This is advantageous in polishing operations. However, if desired, the wheel 54 may also be fixed such that it does not move during grinding or polishing of the part. This may be advantageous in some grinding operations to meet the part shape and size tolerances, in accordance with part print specifications.

The axis of the second wheel 54 is preferably positioned 19 inches above the axis of the first wheel 44. This allows the robot arm (see FIG. 1) to reach the second wheel 54 and/or belt 28 while ensuring ample space between the wheels 44 and 54 for movement of the robot arm. Also, the second wheel 54 is preferably spaced apart from the front of the base 18 (the side of the base 18 on which the wheels 44 and 54 are located) by a distance that is greater than a distance the first wheel 44 is spaced apart from the front of the base (see FIG. 3). This causes the second wheel 54 to be horizontally offset from the first wheel 44 (in a side view) to provide clearance beneath the second wheel 54.

The third head 24 is preferably identical to the second head 22 and includes a third motor 148 (see FIG. 4) centrally mounted between the side members 34*a* of the upper portion 34 of the base 18. Preferably, the third motor 148 is mounted between the upper two cross panels 34*b*, aligned along a common vertical axis with the second motor 48, and laterally offset relative to the first motor 36. The third motor 148 preferably comprises a 5 HP 1800 RPM motor although other motors could substitute therefore. A third power belt 150 drivingly interconnects the motor 148 and a hub 152. The hub 152 is connected to a third wheel 154 and transfers rotation from the belt 150 thereto. A power belt idler pulley 155 mounted between the hub 152 and the motor 148 maintains the tension of the belt 150.

In the illustrated example, the third wheel 154 is in the form of a contact wheel for supporting the third finishing belt 30. The third finishing belt 30 extends between the third wheel 154 and a third abrasive belt idler pulley 156. The idler pulley 156 maintains tension on the belt 30. The wheel 154, pulley 155, and pulley 156 are all mountably supported on a second elongated housing (e.g., an aluminum casting) 158 which is mounted on the upper portion 34 of the base 18 so as to laterally extend beyond both side members 34*a*. Preferably, the wheel 154 is mounted to one end of the housing 158 while the pulley 155 is mounted to an opposite second end. Also preferably, the axes of rotation of the third wheel 154, third motor 148, and third idler pulley 156 are all substantially located along a common horizontal plane above the floor.

In this embodiment, the third wheel 154 floats by way of a force controlled float mechanism such that it may move when the wheel 154 and/or belt 30 is used to grind or polish a part (see. FIG. 1). This is advantageous in polishing operations. However, if desired, the wheel 154 may also be fixed such that it does not move during grinding or polishing of the part. This may be advantageous in some grinding operations to meet the part shape and size tolerances, in accordance with part print specifications.

The axis of the third wheel 154 is preferably positioned 17 inches above the axis of the second wheel 54. This allows the robot arm (see FIG. 1) to reach the wheel 154 and/or belt 30 while ensuring ample space between the wheels 54 and 154 for movement of the robot arm. Also, as stated above, the third wheel 154 is aligned along a common vertical axis with the second wheel 54. Further, the second wheel 54 and the third wheel 154 are spaced apart from the front of the base 18 by a substantially equal distance to ease manufacturing.

Thus, a three wheel head apparatus is provided for robotic finishing operations. Since the three heads are vertically stacked, the apparatus occupies a minimum of floor space. Also, since the position of each head relative to the others and relative to the robot is purposefully selected, the robot may reach all of the heads without interference.

The description of the invention is merely exemplary in nature and, thus, variations that do not depart from the gist of the invention are intended to be within the scope of the invention. For example, while a left hand apparatus has been described and illustrated, a right hand apparatus could also be provided by reversing the parts. Further, while the wheels are depicted as having certain diameters, the diameters may be modified so long as operational (e.g., robotic) clearance is ensured. Specifically, the diameter of the first contact wheel can be greatly reduced for different processing steps. The illustrated diameter perceives a gate grinding operation. Such variations are not to be regarded as a departure from the spirit and scope of the invention.

What is claimed is:

1. A finishing apparatus comprising:

a base adapted to stand on a floor;

a first finishing head mounted to the base, the first finishing head being located above the floor;

a second finishing head mounted to the base, the second finishing head being located above the first finishing head relative to the floor; and a third finishing head mounted to the base, the third finishing head being located above the second finishing head relative to the floor;

wherein the base further comprises:

a lower portion including:

a pair of laterally spaced apart upstanding legs; and an upper support member connected to each of the laterally spaced apart legs; and an upper portion mounted on top of the lower portion, the upper portion including:

a pair of laterally spaced apart upstanding side members mounted to the upper support member of the lower portion; and a plurality of cross panels extending between the pair of laterally spaced apart side members.

2. The finishing apparatus of claim 1 wherein:

one of the pair of laterally spaced apart side members of the upper portion is substantially vertically aligned above one of the pair of legs of the lower portion; and the other of the pair of laterally spaced apart side members of the upper portion is laterally offset from the other of the pair of legs of the lower portion.

3. A finishing apparatus comprising:

a base adapted to stand on a floor;

a first finishing head mounted to the base, the first finishing head being located above the floor;

a second finishing head mounted to the base, the second finishing head being located above the first finishing head relative to the floor; and a third finishing head mounted to the base, the third finishing head being located above the second finishing head relative to the floor;

wherein the first finishing head further comprises:

a motor mounted to the base;

a wheel mounted to the base above the floor;

a driving belt extending between the motor and the wheel;

a pulley mounted to the base at a location laterally spaced apart from the wheel and above the floor; and a finishing belt extending between the wheel and the pulley.

4. The finishing apparatus of claim 3 wherein an axis of rotation of the wheel and an axis of rotation of the pulley are substantially located in a common horizontal plane above the floor.

5. The finishing apparatus of claim 3 wherein:

the base further comprises a lower portion and an upper portion mounted on top of the lower portion; and the wheel is located at an interface of a leg of the lower portion and an upper support surface of the lower portion.

6. The finishing apparatus of claim 5 wherein the pulley is mounted to an end of the upper support surface opposite the wheel.

7. The finishing apparatus of claim 3 wherein the second finishing head further comprises:

a second motor mounted to the base;

a second wheel mounted to the base substantially vertically above the wheel;

a second driving belt extending between the second motor and the second wheel;

a second pulley mounted to the base at a location laterally spaced apart from the second wheel; and a second finishing belt extending between the second wheel and the second pulley.

8. The finishing apparatus of claim 7 wherein the second wheel is spaced apart from a front of the base by a greater distance than the wheel.

9. The finishing apparatus of claim 7 wherein an axis of rotation of the second wheel and an axis of rotation of the second pulley are substantially located in a common horizontal plane above the floor.

10. The finishing apparatus of claim 9 wherein an axis of rotation of the second motor is substantially located in the common horizontal plane above the floor.

11. The finishing apparatus of claim 7 wherein:

the base further comprises a lower portion and an upper portion mounted on top of the lower portion; and the second wheel is located at a first end of a housing mounted to the upper portion of the base.

12. The finishing apparatus of claim 11 wherein the second pulley is mounted to a second end of the housing opposite the first end.

13. The finishing apparatus of claim 7 wherein the third finishing head further comprises:

a third motor mounted to the base;

a third wheel mounted to the base substantially vertically above the second wheel;

a third driving belt extending between the third motor and the third wheel;

a third pulley mounted to the base at a location laterally spaced apart from the third wheel; and a third finishing belt extending between the third wheel and the third pulley.

14. The finishing apparatus of claim 13 wherein the second and third wheels are spaced apart from a front of the base by a substantially equal distance.

15. The finishing apparatus of claim 13 wherein an axis of rotation of the third wheel and an axis of rotation of the third pulley are substantially located in a common horizontal plane above the floor.

16. The finishing apparatus of claim 15 wherein an axis of rotation of the third motor is substantially located in the common horizontal plane above the floor.

17. The finishing apparatus of claim 13 wherein:

the base further comprises a lower portion and an upper portion mounted on top of the lower portion; and the third wheel is located at a first end of a housing mounted to the upper portion of the base.

18. The finishing apparatus of claim 17 wherein the third pulley is mounted to a second end of the housing opposite the first end.

19. A finishing apparatus comprising:

a base adapted to stand on a floor, the base including:

a lower portion including:

a pair of laterally spaced apart vertical legs; and a horizontal upper support member connected to each of the laterally spaced apart legs; and an upper portion mounted on top of the lower portion, the upper portion including:

a pair of laterally spaced apart vertical side members mounted to the upper support member of the lower portion, one of the pair of laterally spaced apart side members being substantially vertically aligned above one of the pair of legs of the lower portion, and the other of the pair of laterally spaced apart side members being laterally offset from the other of the pair of legs of the lower portion; and a plurality of horizontal cross panels extending between the pair of laterally spaced apart side members;

a first finishing head mounted to the base, the first finishing head including:

a first motor mounted to the base;

a first wheel mounted to the base at an interface of the one of the pair of legs of the lower portion and the upper support surface of the lower portion;

a first driving belt extending between the first motor and the first wheel;

a first pulley mounted to an end of the upper support surface opposite the first wheel, an axis of rotation of the first wheel and an axis of rotation of the first pulley being substantially located in a first common horizontal plane above the floor; and a first finishing belt extending between the first wheel and the first pulley;

a second finishing head mounted to the base, the second finishing head including:

a second motor mounted to the base;

a second wheel mounted at a first end of a first housing mounted to the upper portion of the base, the second wheel being located vertically above the first wheel and spaced apart from a front of the base by a greater distance than the first wheel;

a second driving belt extending between the second motor and the second wheel;

a second pulley mounted to a second end of the first housing opposite the first end, an axis of rotation of the second wheel, an axis of rotation of the second pulley, and an axis of rotation of the motor being substantially located in a second common horizontal plane above the floor; and a second finishing belt extending between the second wheel and the second pulley; and a third finishing head mounted to the base, the third finishing head including:

a third motor mounted to the base;

a third wheel mounted at a first end of a second housing mounted to the upper portion of the base, the third wheel being located substantially vertically above the second wheel, and the second and third wheels being spaced apart from the front of the base by a substantially equal distance;

a third driving belt extending between the third motor and the third wheel;

a third pulley mounted to a second end of the second housing opposite the first end, an axis of rotation of the third wheel, an axis of rotation of the third pulley, and an axis of rotation of the third motor being substantially located in a third common horizontal plane above the floor; and a third finishing belt extending between the third wheel and the third pulley.

* * * * *